US005527185A

United States Patent [19]

Davis

[11] Patent Number: 5,527,185

[45] Date of Patent: Jun. 18, 1996

[54] ATHLETIC TRAINING DEVICE

[76] Inventor: Timothy J. Davis, 1912F Kenwere Dr., MacDill AFB, Fla. 33621

[21] Appl. No.: 456,501

[22] Filed: Jun. 1, 1995

[51] Int. Cl.[6] ..... A63B 69/00

[52] U.S. Cl. ..... 434/248; 434/251; 434/256; 434/247; 273/1.5 A; 273/26 R; 273/55 R; 273/57.2

[58] Field of Search ..... 434/256, 251, 434/250, 248, 247, 86; 273/1.5 A, 26 R, 26 A, 55 R, 57.2; 472/81, 84, 75, 70; D21/166, 167, 172, 199, 200, 201

[56] References Cited

U.S. PATENT DOCUMENTS

| | | | |
|---|---|---|---|
| D. 321,370 | 11/1991 | Curtis | D19/62 |
| 3,552,749 | 1/1971 | Piggotte | 273/1.5 A |
| 3,675,921 | 7/1972 | Meyers, Jr. | 273/1.5 A |
| 3,680,862 | 8/1972 | Russell et al. | 273/55 R |
| 4,489,940 | 12/1984 | Amundson | 273/57.2 |
| 4,688,792 | 8/1987 | Rivkin | 273/55 R X |
| 4,781,376 | 11/1988 | Barnes, Sr. | 273/26 A |
| 4,989,862 | 2/1991 | Curtis | 273/1.5 A |

*Primary Examiner*—Gene Mancene
*Assistant Examiner*—Jeffrey A. Smith
*Attorney, Agent, or Firm*—Dominik & Stein

[57] ABSTRACT

An athletic training device comprising a base, an upright supported by the base, and a planar training shape simulative of a human athlete, including head, torso, arms and legs, mounted on said upright. The vertical height of the training shape is adjustable, and the arms articulate at the elbows and shoulders so that the position of the arms is adjustable. The training shape will remain at a predetermined height with the arms in a predetermined posture, so that the training device will represent an opponent at the precise posture and position for which the ball handler seeks to develop the countermove. Once the simulated opponent is countered at a first position and height, the height of the opponent can be raised in the same way that a track and field high jumper will raise the bar once he comfortably clears a given height.

13 Claims, 4 Drawing Sheets

ATHLETIC TRAINING DEVICE

BACKGROUND OF THE INVENTION

1. Field of the Invention

The present invention is directed to a device for physically and psychologically conditioning an athlete to play against an opponent, particularly an opponent with a characteristic blocking posture and position. More specifically, the present invention is directed to a simulated opponent capable of holding a specific posture and position, such as a pass or shot blocking posture, against which a ball handler desires to develop a countermove.

2. Description of the Related Art

Basketball is a true test of an athlete in that it requires skill, stamina, and mental toughness. It is not enough that the athlete possess physical skill in ball handling, but the athlete must possess this ball handling skill in the presence of an opponent determined to spoil the aim of a ball handler. It is common practice for an opponent to attempt to block a shot by interposing himself between the ball carrier and the basket. In addition, the shot blocker will talk to, make aggressive gestures, jest with, insult, cajole or otherwise attempt to distract the ball carrier from his aim.

Accordingly, the complete conditioning of a well-rounded athlete requires training in all areas, not the least of which concerns the ability to psychologically address an opponent or, as the case may be, to set the opponent out of mind.

One way to develop this psychological ability to concentrate on shooting despite the presence of an opponent is by actually playing many games of basketball. However, the serious athlete will spend many hours in off-court practice for each hour of on-the-court game time. Much basketball practice is done in driveways, schoolyards, and small lots and generally in the absence of intense competitors. As a substitute for human opponents, various devices have been developed in the past to simulate a human opponent in order to psychologically accustom a ball handler undergoing training to the presence of an opponent. That is, the ball handler should reach the point where he will consider an opponent to be a normal part of the environment, and not be distracted or intimidated by the presence of such an opponent.

The present inventor began his investigations by studying devices intended to simulate a basketball shot blocker. Various exemplary devices of this type developed in the past for training athletes for competition are discussed below.

U.S. Pat. No. 3,868,108 to Kirchner teaches a device mounted on the head of an athlete undergoing training which partially obstructs the user's vision. The device comprises a headband or the like, a sight-obstructing shape, such as the figure of a human hand, spaced several inches in front of the eyes of the wearer, and a spacing member connecting the shape to the headband. By wearing the sight-obstructing device while practicing the game, the ball carrier becomes accustomed to playing under conditions of obstructed vision, with the objective of being accustomed to playing while an opponent waves a hand in front of the ball handler's face while shooting baskets. However, this device only simulates obstructed vision. It does not present a physical obstacle, particularly an obstacle at a specified position and height, blocking the shot of the ball carrier so as to challenge the shot making ability of the ball handler.

U.S. Pat. Des. 321,370 to Curtis shows a simulated basketball player attached to a platform. No dimensions or function of the device are disclosed, but if the device were dimensioned for use as a simulated opponent on a basketball court, the device would be rather defective in that it does not simulate the actual posture of a basketball player, and particularly a shot blocker, and thus can not be used to practice shooting. Further, even if the device could be made to simulate a shot blocker, the device stands flat on the floor and can not simulate a jumping shot blocker.

U.S. Pat. No. 5,160,138 to Sanders teaches an athletic training device which includes a carriage with at least one wheel. A pivotable projection extends upwards from the carriage and terminates in a blocking screen. The carriage is connected from the back via an extension of a specified length to a basketball backboard. The carriage is connected from the front to the player by a cord. When the player moves laterally, the carriage follows the player's movements. Additionally, when the cord is attached to the upwardly directed projection above a pivot point, the projection pivots and blocks the player's attempts to shoot or pass the basketball. The device is, however, rather complex and expensive, and difficult to set up and use. The device may develop shooting skills and mechanical skills, but the device does not provide psychological conditioning to the presence of an opponent and thus does not psychologically toughen the athlete against the opponent.

U.S. Pat. No. 3,552,749 to Piggotte discloses a shot-blocking device which comprises a life-sized figure with four different "arms" projecting outward from the figure which can be rotated in either direction in the manner of a windmill, with the arms describing a large circle. However, the device is electrically driven and thus requires an electric motor and a power source, usually a 110 volt outlet and extension cord. If a source of electrical power can be found near a basketball court, an electrical extension cord must be run from the electrical outlet to the training shape. The extension cord presents a trip or slip hazard to the ball handler, and must be taped down. The side of the training shape on which the electrical extension cord will usually be off limits to the ball handler, and this severely reduces the types of exercises the ball handler may perform. Further, the device is very sturdy, and can injure a player upon collision. More significantly, the device has no resemblance to a human opponent and, therefore, does not provide psychological conditioning.

U.S. Pat. No. 3,675,921 to Meyers, Sr. discloses a device which comprises a representation of an opposing player and a device which moves the representation up and down to simulate jumping. The representation is vertically adjustable to simulate players of different height, and has motorized pivoted arms which swing upwardly as the figure jumps upwardly. Either or both of the arms can be disconnected from the drive motor. The device can be made to jump once, to jump repeatedly, or to jump when initiated by remote control or by a player. This device has numerous disadvantages, including the expense associated with the intricate mechanization of the figure for jumping and the arms for pivoting upwardly during jumping, which expense renders the device unaccessible to the conventional basketball player; the large number of parts and thus the likelihood of parts failure; the requirement for electrical power to power the device, with electrical power not being readily accessible on most basketball courts; and the fact that the figure is intended to be unpredictable, which, however, renders the device unsuitable where the player seeks to develop a specific move against an opponent.

U.S. Pat. No. 4,538,808 to Holland teaches a device for training basketball players to shoot, and more specifically, a device which accustoms the basketball player to physical contact by opposing players. The device comprises a tubular framework defining an opening through which a basketball player must enter for shooting the ball. Members simulating arms project into the space and brush against the basketball player while the player moves into the shooting position. The device does not condition the athlete to outperform a shot blocker, nor does the device train the athlete repetitively to perform a specific shot.

While the above discusses the need to condition basketball players, the need to condition athletes is obviously not limited to basketball. U.S. Pat. No. 4,699,386 to Carzino teaches the conversion of a basketball batting cage to a soccer practice machine. A shooter standing at one end of the cage can kick the ball against a simulated goal at the other end of the cage. A simulated goalie hangs at the other end of the cage and is moveable laterally in response to electro-optic devices which sense the direction of the movement of the ball. The device is intended more for short-term amusement than practical use for conditioning athletes and is limited in the type of skills which can be developed. Further, the device is impractical in terms of a cost-effective training device for training athletes.

As new training devices are developed and tested, and as the advantages of the devices become apparent, so do the disadvantages. Following careful analysis, the inventor has determined that virtually all of the known shot blocking devices are based upon the presumption that the opponent may have a limited range of movement, but that his position is variable. The devices thus go through great lengths to simulate a moving opponent presuming that it is necessary to accustom the athlete to a moving opponent. The present inventor has studied the above available training devices, and has determined that there is actually a basic flaw in training philosophy underlying the design of the conventional shot-blocking training devices. More specifically, the inventor has determined that players do not reinvent their moves with each game; rather, the players have developed specific moves for specific situations. For example, in the game of basketball, a shot blocker will wait until the precise moment he believes that the ball handler will jump and shoot, and will himself jump upwards in an attempt to block the shot. The ball handler, recognizing the predictable behavior, will dribbel to the basket, stop and feign a jump, wait for the shot blocker to commit to a jump, will perhaps take a step backward, and will then jump and shoot as the shot blocker is coming down from his jump. Accordingly, the position of the opponent is predictable, and the ball carrier will want to perfect a countermove by practicing running up to the basket and shot blocker, taking a step backward, and jumping and shooting over the shot blocker. The above-described training devices do not permit this type of training.

It is thus an object of the invention to develop a device capable of simulating an opponent, such as a basketball shot blocker, which device will enable the basketball player to practice an approach, retreat, and jump shot over or around a shot blocker.

It is another object of the invention to provide a device which enables a basketball player to develop ball handling skill, to develop psychological awareness of a predictable opponent, to practice developing a routine shot against simulated bodily interference, and to practice the overcoming of an opponent at any desired height or position of blocking a shot.

SUMMARY OF THE INVENTION

Following extensive investigation and experimentation, the present inventor has discovered the flaw in the conventional training philosophy, and determined that a new type of training device is needed. The training device must be capable of representing an opponent at a fixed specific critical posture and position, such that the ball handler can address the shot blocker at this most critical point and develop a move which will enable him to overcome the shot blocker.

It is thus an object of the invention to provide a simulated opponent which can be set to a predetermined posture and position (e.g., height), and which can give the ball handler immediate feedback as to whether he is able to overcome an opponent at a specific posture and height.

It is a further object of the invention to provide a device which can be readily assembled from few parts, and be disassembled to a compact, easily transportable package.

It is yet a further object of the invention to overcome the complexity and expense of simulated opponents. Not only should the simulated opponent be inexpensive, it must be readily adapted to a number of different postures (e.g., shot blocker, pass blocker) as well as be capable of use in a number of different sports, such as volleyball, soccer, football, baseball, etc.

Yet a further object of the invention is to provide a simple and inexpensive simulated opponent which can simulate any posture position and height of an opponent, and which can be employed in any number of sports, particularly in sports wherein the ball handler attempts to propel the ball into a goal and the opponent attempts to block the travel of the ball.

These and other objects of the invention are accomplished by means of an athletic training device comprising a base, an upright supported by the base, and a planar training shape simulative of a human athlete, including head, torso, arms and legs, mounted on said upright. The vertical height of the training shape is adjustable, and the arms articulate at the elbows and shoulders so that the position of the arms is adjustable. The training shape will remain at a predetermined height with the arms in a predetermined posture, so that the training device will represent an opponent at the precise posture and position for which the ball handler seeks to develop the countermove. Once the opponent is countered at a first position and height, the height of the opponent can be raised in the same way that a track and field high jumper will raise the bar once he comfortably clears a given height.

The foregoing has outlined rather broadly the more pertinent and important features of the present invention in order that the detailed description that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other athletic training devices for the same purposes of the present invention. It should also be realized by those skilled in the art that such equivalent structures do not depart from the spirit and scope of the invention as set forth in the appended claims.

BRIEF DESCRIPTION OF THE DRAWINGS

Further objectives and advantages of the present invention will become apparent from a careful reading of the detailed description provided hereinbelow, with appropriate reference to the accompanying drawings.

DETAILED DESCRIPTION OF THE INVENTION

Figure 3:
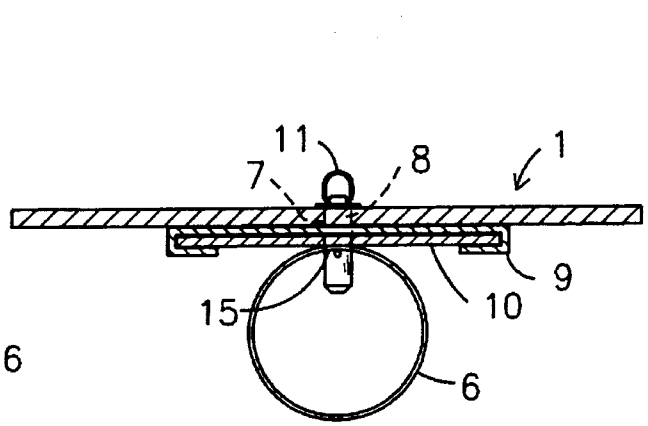
FIG. 3 is a top cross-sectional view of the mounting hardware taken across section line 3—3 of FIG. 1.

With experience, it will become apparent to a ball handler that any opponent has (1) a limited number of potential blocking moves, and (2) a limited range of movement. The opponent can be overcome if the ball handler is able to (1) set up an opponent to commit to a blocking move, and (2) perform the countermove which will overcome the shot blocker, particularly if the countermove can be performed at a point of vulnerability of the shot blocker (e.g., the ball handler should force the opponent to jump, wait until the opponent is returning to earth, and then jump and shoot before the opponent can jump again).

To make it possible to train for such a maneuver, the present invention provides a training device simulative of a human opponent which training device can be set up at the precise posture and elevation against which the athlete undergoing training intends to develop a countermove. The device is capable of simulating any type of opponent, such as an opponent attempting to block a volleyball, an opponent attempting to block a soccer ball, an opponent attempting to block a basketball, or even a string of five or more opponents attempting to block a football kick.

It will also be readily understood that the simulated training device is capable of being positioned at any point in the field of play, not only directly in front of the goal or basket. Thus, for example, the training device is capable of being placed in the middle of a soccer field, hockey field, ice hockey ring, or in the middle of a basketball court, and permits the athlete to dribbel, move, pass, or kick the ball around the training device(s).

In every case, the arms of the simulated opponent should be capable of being arranged to the appropriate posture for blocking. For example, in basketball, the shot blocker should be capable of being elevated to simulate jumping, and the simulated shot blocker should be able to extend at least one arm in the manner of a shot blocker as conventional in basketball. The same simulated training device should be capable of being placed in the center of a basketball court and to be positioned with arms partially extended, bent at the elbows, in order to simulate a pass-blocking opponent attempting to interfere with the ball handler.

The simulated training device should also be capable of being placed at the three-point line in a basketball court and to simulate the position and posture of an opponent attempting to interfere with a shot from the three-point line. This makes it possible for the ball handler to practice shooting from the three-point line over an opponent. Obviously, the trajectory necessary to clear an opponent and reach the basket is different than the trajectory needed to merely reach a basket in the absence of the need to shoot over a shot blocker.

In order to accomplish the above objective, the present inventor has developed a simulated opponent which is a substantially planar training shape simulative of a human athlete, including a head, torso, arms and legs. At least the arms are capable of being moved at the shoulders and elbows so as to simulate various blocking postures. Using a basketball player shape, as a non-limiting example, the simulated basketball player may be positioned with arms slightly extended to simulate an opponent attempting to block a pass. The ball handler can practice dribbeling with the ball around one or more of such pass-blocking opponents arranged around a basketball court. The same simulated basketball player may be positioned near a basket with two arms raised in order to simulate the blocking of a two-point shot from under the basket. Next, the same simulated basketball opponent can be placed at the three-point line of the basketball court with one arm raised and stretched, enabling the basketball handler to train for three-point shots over this training device.

At a different time, the very same basketball player may be placed on a volleyball court and positioned with both arms raised in order to simulate the attempted blocking of spike.

The important feature of the invention is that the simulated opponent training device be capable of being adjusted to a predetermined position and height so as to provide a specific barrier which the ball handler can repeatedly address and attempt to develop a countermeasure. Only by repeating a countermove numerous times will the ball handler be able to develop the ability to overcome an opponent, with the move becoming second nature. In this way, the present invention adopts some of the philosophy of martial arts, wherein the same move is repeated hundreds of times in order to become second nature.

In order to further enhance the psychological value of the simulated training device, the simulated training device will be provided with a face representing a human face and a full training shape image representing a complete athletic opponent. The figure may be made realistic as by providing a photographic image, or the face may be a cartoon-like image. The face and training shape may be permanently attached or painted on, or may be removable, coverable, and/or replaceable, such as by a self-adhesive peel-off image or by a removable transfer image or transparent decal applied over a white background, so that the race, gender, and personal identity of the opponent may be changed at will. The training device may be provided with a uniform representing a particular sport. For example, a basketball uniform may be painted on the shape. Alternatively, an old uniform, or even an old basketball shirt, may be draped over the training shape to provide a more realistic appearance to the shape. In this way, the shape may be used for basketball one day and volleyball the next day.

The body of the player may be comprised of a thin sheet of metal, wood, carbon fiber, or other generally rigid durable flat material, but for reasons of economy, availability, ease of working, and durability, the body is preferably formed from a thin sheet of rigid plastic. The plastic may be flat or may be provided with corrugations, and is preferably selected so as to be weather resistant and relatively shock resistant. The training shape may be provided with a "skeleton" of stiffening members 16 such as spars or battens, but these are not required.

In order to be capable of being arranged into a variety of positions, the arms should be hinged or pivotable at the shoulders and elbows. The articulated joints may be constructed using rivets, nuts and bolts, or any type of fastener which permits the joint to be relaxed for movement and tensioned for maintaining the desired posture.

Although not required, it is possible to have the legs articulated at the hips and knees in order to provide further posturing of the simulated opponent. However, for the purposes of the present invention, the moveability of legs is a secondary importance and, for reasons of economy, cost savings and durability, articulated legs are not part of the preferred embodiment of the invention.

The simulated training shape is mounted on an upright so as to be height adjustable. The means of mounting can be VELCRO hook-and-pile fastener, snap fasteners, etc. However, for securely holding the simulated training device on the upright even when the training device is impacted by the ball or ball handler, it is preferred that the mounting means provide a substantially rigid attachment. One preferred example of such a semirigid attachment means using one or more pins and holes, is discussed below in greater detail with respect to the training shapes.

Figure 1:
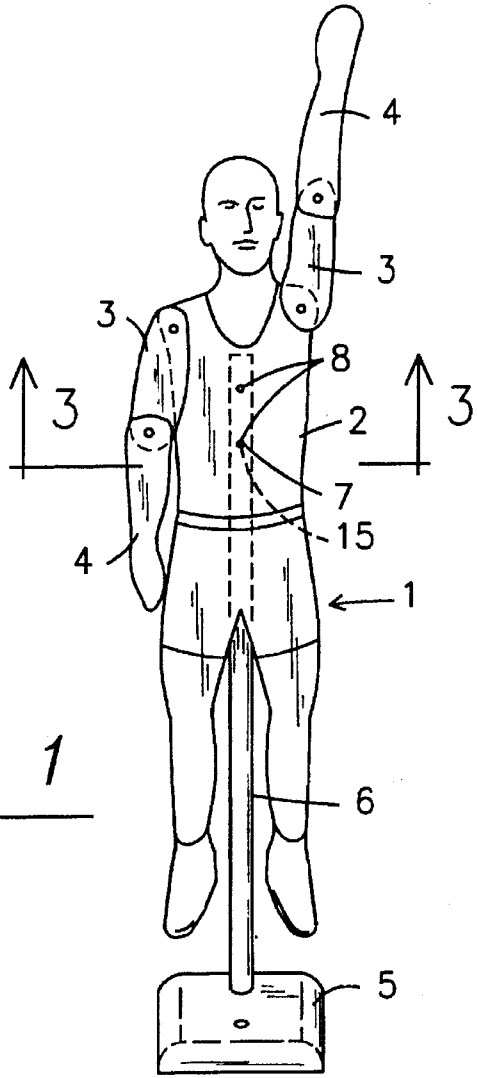
FIG. 1 is a front elevational view of a simulated basketball shot blocker in a shot blocking posture.
Figure 5:
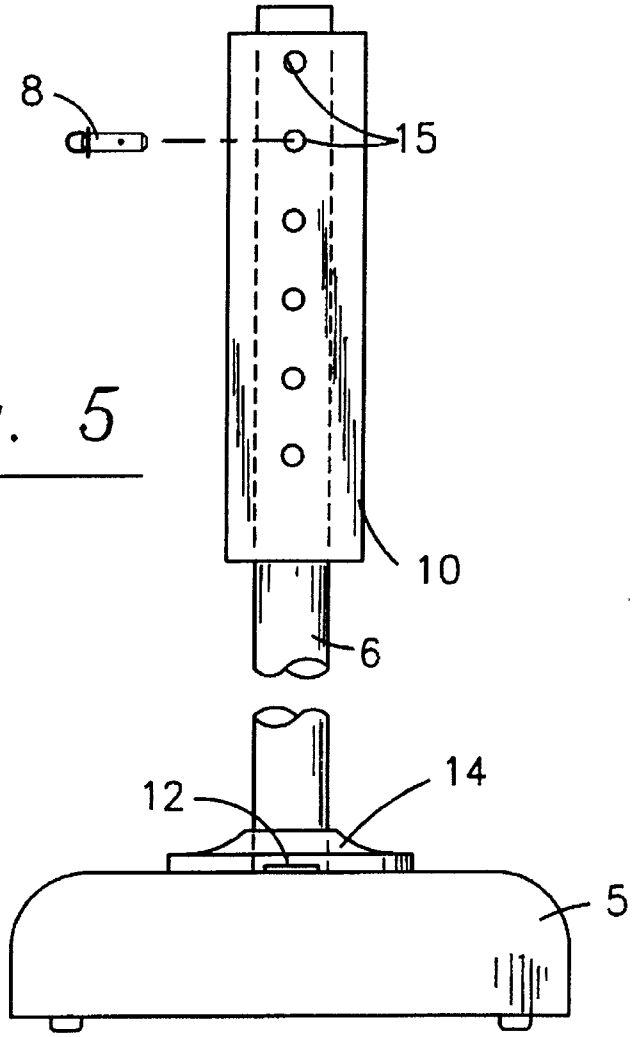
FIG. 5 is a front view of the base and upright to which the training shape can be mounted.
Figure 4:
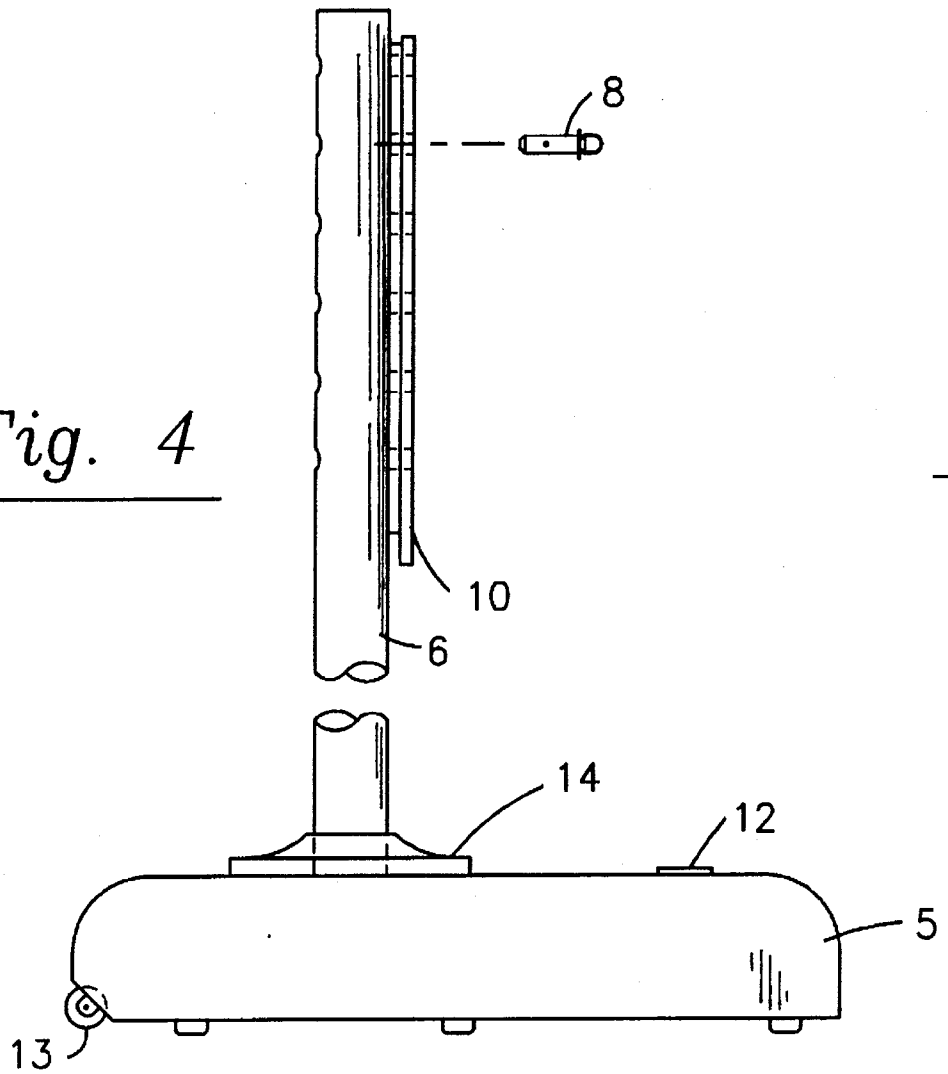
FIG. 4 is side view of the base and upright to which the training shape can be mounted.

As seen in FIG. 1, a simulated basketball player training shape 1 is comprised of a rigid torso 2 on which are mounted flexible, pivotable, positionable upper arm segments 3 and lower arm segments 4. The training shape 1 is mounted on, section line 3—3 and FIG. 3, an upright 6 which in turn is mounted on a base 5. The vertical height of the training shape 1 can be altered by sliding the training shape up and down on upright 6 until the training shape 1 reaches the desired height where through-hole 7 in the training shape aligns with a through hole 15 in the upright 6, and then inserting pin 8 through holes 7, 15 to retain the training shape at the desired height.

Figure 2:
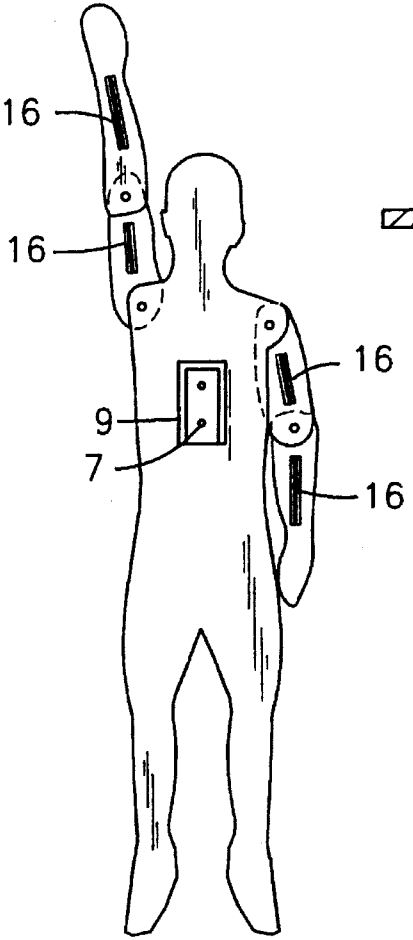
FIG. 2 is a back elevational view of the simulated basketball shot blocker of FIG. 1, with a first embodiment of mounting hardware shown with details exaggerated.

Turning to FIGS. 2 through 6, to the front side of upright 6, that is, the side of upright 6 facing the training shape, an elongated rectangular strip of metal 10 is welded or otherwise rigidly attached. A metal bracket dimensioned to slidingly engage strip of metal 10 is rigidly attached to the back side of the training shape of FIG. 1 as shown in FIG. 2. When the metal bracket 9 is slid over the strip of metal 10, the training shape 1 is prevented from rotation and can only move up and down. The training shape 1 is adjusted until the desired height is reached and through holes 7, 15 line up in training shape 1, strip of metal 10 and upright 6, and then key or pin 8 is inserted through holes 7, 15 so as to rigidly hold the training shape 1 in position.

Numerous variations of the above can be envisioned. For example, metal bracket 9 can be constructed as a flat sheet of metal rather than a metal bracket. In this case, the insertion of a single pin 8 through hole 7 will not rigidly hold training shape 1 in the upright position, but will permit training shape 1 to pivot back and forth as though the feet were a pendulum. For certain training applications, it may be desirable to have the training shape 1 capable of swinging or pivoting back and forth, such that the arms can simulate movement. However, as discussed above, it is preferred for the purposes of the present invention that the training shape 1 be immobilized, and in the case that the metal bracket 9 is replaced with a flat metal strip, the immobilization is accomplished by insertion of a second pin or key 8 into a second hole in the training shape 1 and upright 6.

Figure 7:
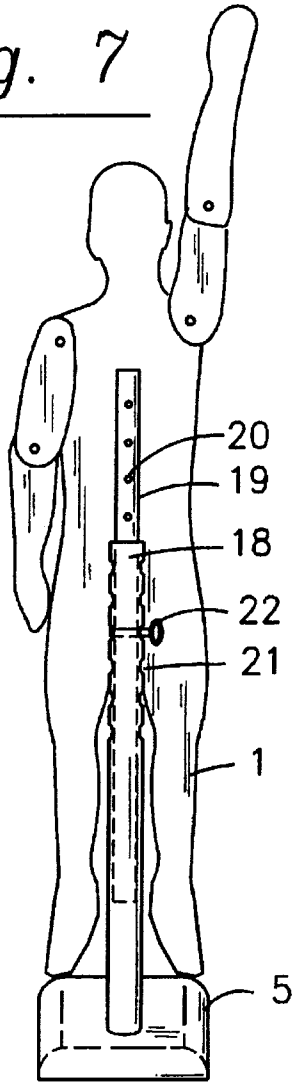
FIG. 7 is a back elevational view of the simulated basketball shot blocker of FIG. 1, mounted on a telescoping upright.
Figure 6:
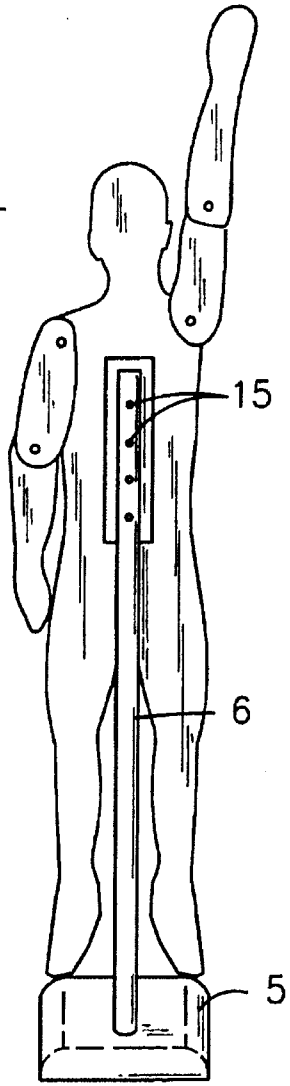
FIG. 6 is a back elevational view of the simulated basketball shot blocker of FIG. 2 mounted on a fixed upright.
Figure 10:
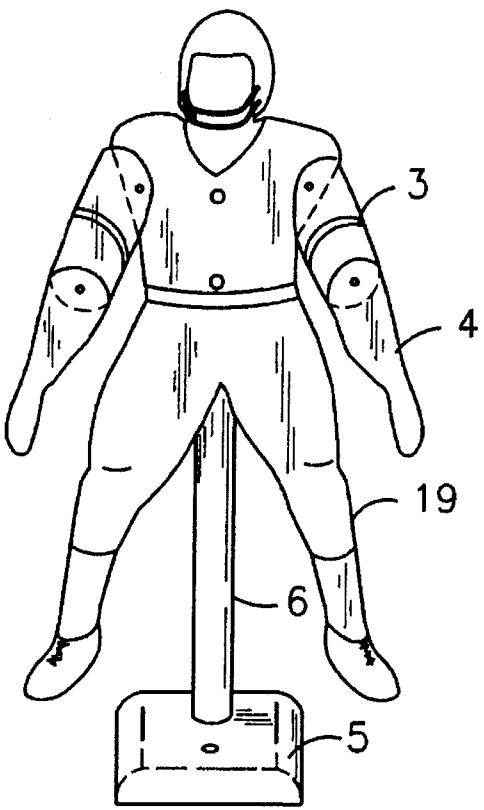
FIG. 10 is a front elevation view showing a simulated football player in a blocking posture.

An even more preferred embodiment of the invention, employing a quick-release telescopic upright, is shown in FIG. 7. In this preferred embodiment, the upright is comprised of a lower hollow cylindrical upright 18 fixed to the base 5 and an upper upright 19 dimensioned for being slidingly displaceable within fixed upright 18. Training shape 1 is releasably attached to upper upright 19. Upper upright 19 is inserted in lower upright 18 and held in place by means of retaining pin 22. Retaining pin 22 is inserted through one of the bore holes 21 provided through the lower hollow cylindrical upright 18 and an upper upright 19. These retaining pin bore holes are preferably provided parallel to the training shape and perpendicular to the bore holes 20 in the upper upright 19 for securing the training shape to the upper upright. In order to adjust the height of the training shape 1, it is merely necessary to remove retaining pin 22, to slide upper upright 19 and thereto attached training shape 1 up or down to the desired height, and then to again insert retaining pin 22.

In a preferred embodiment, the hollow lower upright is approximately 5 feet high, 4 inches in outer diameter, with ¼ inch diameter retaining pin holes space approximately 6 inches apart. Upper upright is dimensioned for insertion into lower upright, is approximately 5 feet long, and has ¼ inch retaining pin holes at approximately 6 inch intervals. The retaining pin is approximately 7 inches long, ¼ inch in diameter, and is provided with a rubber or rubber coated grip part so that, in the case that an athlete falls against the retaining pin grip part, he does not seriously injure himself.

Base 5 may be provided as a light weight, but wide base so as to support the training device against falling over when bumped by the ball handler, or may be a relatively narrower diameter weighted base provided with sufficient weight so as to prevent the training device from tipping over upon being bumped by the ball handler. The weighted base may be a substantially hollow plastic enclosure with an opening 12 for filling with water. However, in the case that the shape is to be used on a hardwood floor, it is preferred that the shape be filled with sand or concrete rather than water so as to prevent spilling of water onto the hardwood floor.

The base as shown in FIG. 1 is substantially square, but with a U- or V-shaped cut-out in the front. This cut-out is provided for safety, so that the ball handler can approach the training device, jump, and land in front of the training device with minimal concern of stepping on the base of the training device and possibly twisting an ankle. Such a cut-out is, however, not entirely necessary as 75 to 90% of the base is provided behind the training device and only a small part of the base, if any, projects beyond the front of the training device.

The upright 6 is attached to the base in a manner to be easily removable, such as in a socket provided in the base, such that the training shape 1, upright 6 and base 5 can be easily disassembled into at least three separate components which can be easily carried and placed into, e.g., an automobile. The base may also be provided with wheels 13 so as to be easily wheeled from, e.g., the basketball court to a storage locker or office.

The method of using the training device in accordance with the present invention will now be discussed in greater detail.

For developing a move against a two-point basketball shot blocker, the training shape 1 may be set at a vertical height appropriate to the ball handler, such as with one arm fully extended upwardly to a height of about 6 feet for a younger athlete, to an arm fully extended upwardly to a height of about 11 feet for a more professional athlete, with the training device placed near a basketball basket. The ball handler rapidly approaches the training device, quickly stops immediately before reaching the training device, imagines that the training device represents an opponent who has just jumped in order to block a shot, takes one step back and imagines that the shot blocker has completed his jump and is on the verge of returning to earth, and then jumps over the descending shot blocker and shoots a basket. The ball handler may want to develop a quick release technique, where entire exercise is performed quickly without thinking, or he may want to develop a "stare-down" technique where he stalls, then surprises the opponent. Further yet, the ball handler can practice backing up to the opponent, then quickly turning around and jumping over the opponent for a jump shot, hook shot, or other shot.

If the same training shape is used for different ball handlers, it is advantageous to have the height of the training shape quickly adjustable.

Next, one or more of the training devices can be placed at mid-court and the ball handler can approach the training shape, feign dribbling to the left and quickly turn and dribbel around the simulated training device to the right. Thereafter, the training device can be set up at the three-point line so that the ball handler can practice shooting and scoring over the simulated opponent.

Figure 8:
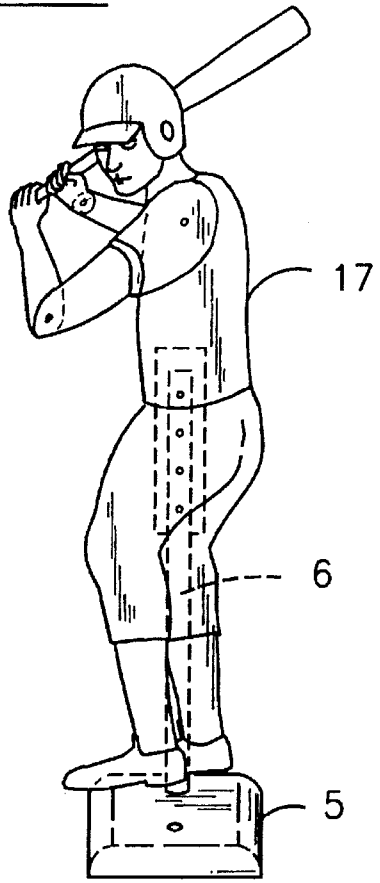
FIG. 8 is a front elevated view showing a simulated baseball batter in a swinging posture.
Figure 9:
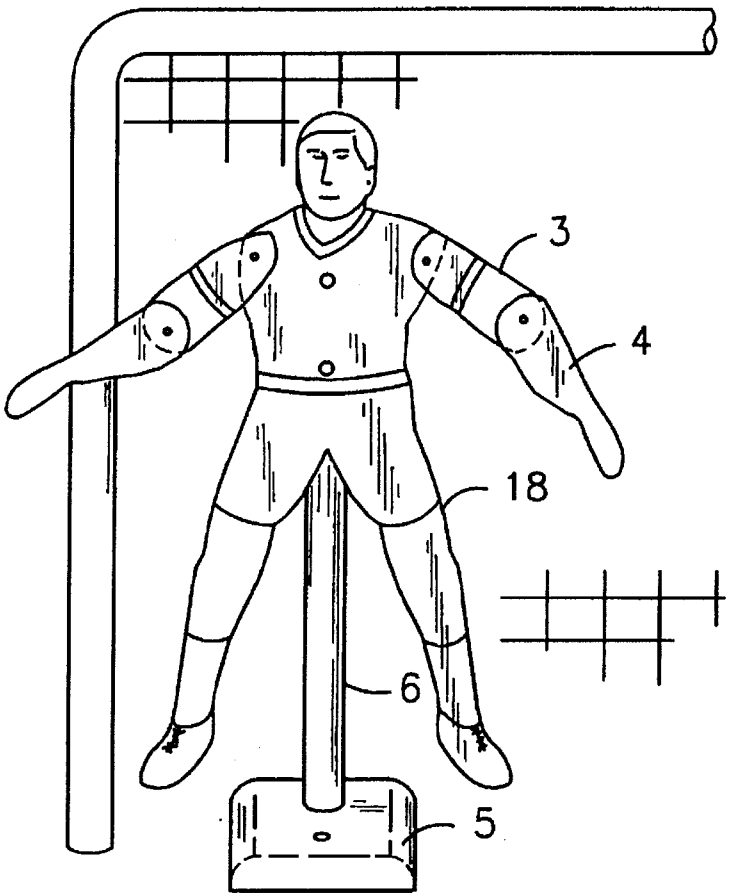
FIG. 9 is a front elevational view showing a simulated soccer goalie in a shot blocking posture.

The same training device as used for basketball can be used for a number of other games such as volleyball or football. As shown in FIGS. 8 and 9, by changing the uniform and the posture and position of the training shape 1, the training shape 1 can be used for baseball 17 or for soccer 18, or for football 19.

When blocking a football kick or pass, it is preferred to have a number of training devices, preferably about five, lined up next to each other and preferably joined at the hip and slightly elevated, so as to give the kicker or quarterback a realistic simulated rush zone (i.e., the zone which may be occupied by the bodies, heads or arms of the kick or pass blockers) which must be cleared in order for the football to reach the goal posts or receiver. Further, rather than have five training shapes positioned side by side, the training shapes may be placed in a group of two and a group of three with a gap between the two groups, so as to train the kicker or quarterback to kick or pass through an "alley" between rushers.

A further use of the training shapes for training football players may be for training offensive players to become familiar with the standard positions of defensive players such as defensive backs. It is well known that defensive players are trained to position themselves at certain positions in order to optimally cover the field and the offensive players. Offensive players, practicing on an empty football field, may attempt to imagine that they are playing in the presence of defensive backs, but in reality they will not be psychologically prepared when the running pattern, visual reference points, and ball travel path appear to be altered due to the presence of the defensive players. In order to provide training using the training shape of the present invention, a number of training shapes are positioned around the football field in positions which will be occupied by the defensive players. The pass receivers can then practice running, breaking, and outwitting the defensive players on the way to their positions, and can prepare themselves for receiving a pass despite the visual interference of the defensive players. Not only does this aid the pass receivers, but it also helps the quarterback perfect his timing and aim in a more realistic environment.

The training device may also be used for baseball (simulating a batter) or ice hockey (simulating a skating training shape), but in these cases, the posture of the training shape is different from that of a basketball player or soccer goalie or volleyball player. For sports in which a different training shape 1 silhouette is required, this can be provided by simply removing the training shape 1 from the upright, and substituting an appropriate training shape 1 (e.g., simulating a baseball batter) in its place. Thus, the basketball player silhouette can be removed and baseball player or hockey goalie player silhouette can be readily substituted in its place. Accordingly, the present invention permits an individual, training camp, or team to purchase one or more uprights and to separately purchase one or more training shapes 1 for each of these uprights, depending on the games and exercises for which training is required.

The manner of constructing a device according to the present invention will now be discussed in greater detail.

The training shape 1 is preferably cut out of plastic and is of a size corresponding to a silhouette of a human, i.e., approximately 6 feet in height. The bracket 9 attached to the rear of the training shape may be anywhere from 4 inches to 2 feet in length, and is preferably approximately 11 to 12 inches. Holes 7, 15 provided through said bracket 9 as well as through the post 6 are preferably spaced about 4 inches apart such that the height of the training shape 1 can be adjusted at 4-inch intervals. The pin or key 8 may be any size or length adapted to securely mating with holes 7, but is preferably approximately 7 inches in length and ¼-inch in width. Accordingly, the diameter of the holes is also approximately ¼-inch. The tip 11 of the key 8 projecting from the front of training shape 1 is preferably made of a rubber material so as to prevent or minimize the likelihood of injury to the training athlete.

In the case that metal bracket element 9 is not C-shaped, it would be possible to ensure that the training shape 1 is rigidly attached to the upright 6 by inserting two or more keys 8.

The upright 6 is preferably a pole, which may be round or square, 5 to 7 feet in height. For most applications, a 5-foot pole is entirely adequate. Beginning approximately 11 inches below the top of pole 6, holes 15 are provided at 4-inch intervals so as to mate with the holes 7 in shape 1.

The base is preferably provided with a mounting bracket 14 or a tubular socket corresponding to the diameter of the upright 6. The upright may be any cross-sectional shape or diameter, but for ease of manufacture, is preferably circular, hollow, and about 4 inches in diameter. The base 5 is approximately 6 inches high and 36 inches in length and width, with the upright mounted approximately 6 inches from the front side of the base. Also provided on the front side of the base are wheels 13, preferably mounted in recesses, such that the training shape can be pivoted forwarded and transported using the integrated wheels. The backside of the base may be provided with suction cups or rubber contact pads so as to prevent movement or slippage of the base when bumped by the ball handler.

In order to enhance the training value of the training shape, the training shape is preferably provided together with a training video showing or demonstrating various exercises to be practiced using the training shape. Such a training video can substantially enhance the enjoyment and training value of the training device.

As can be seen from the above, the training shape according to the present invention is inexpensive, durable and very useful. Whenever an individual seeks to play against an opponent and no opponents are readily available, or whenever a team is short one or more players, the training shape may be placed anywhere in the field of play. The device is perfect for the training of an athlete desiring to perfect a specific move. By repetitively practicing a specific move, the athlete can perfect the move and the move can be second nature when the athlete actually competes and play. The device can improve the play of the athlete by requiring him to place the shot at the specific trajectory required to overcome both the opponent and to place the shot in the goal. The device is simple enough to be readily purchased by the consumer or friends of the athlete, yet is purposeful and provides substantial training value and will thus be appreciated by the athlete.

Although this invention has been described in its preferred form with a certain degree of particularity with respect to a simulated basketball shot blocker, it is understood that the present disclosure of the preferred form has been made only by way of example and that numerous changes in the details of structures and the composition of the combination may be resorted to without departing from the spirit and scope of the invention.

Now that the invention has been described,

What is claimed is:

1. An athletic training device comprising:

a base;

an upright supported by said base; and a planar training shape simulative of a human athlete, including head, torso, arms and legs, wherein said arms include articulating elbow joints and articulating shoulder joints, said joints defining upper and lower arm segments, and means to releasably hold the arms in a desired position, said planar training shape releasably mounted on said upright; and means for adjusting the vertical height of said planar training shape.

2. An athletic training device as in claim 1, wherein said planar training shape is comprised of plastic.

3. An athletic training device as in claim 2, wherein said plastic is provided with corrugations.

4. An athletic training device as in claim 1, wherein said planar training shape is provided with stiffening members along the main axis of the arm segments.

5. An athletic training device as in claim 1, wherein said torso includes shoulders, and wherein said upper arm segments are each connected to a shoulder of said torso and said lower arm segments are rotatably connected to said upper arm segments by means of rivets.

6. An athletic training device as in claim 1, wherein said torso includes shoulders, and wherein said upper arm segments are each connected to a shoulder of said torso and said lower arm segments are rotatably connected to said upper arm segments by means of threaded metal fasteners.

7. An athletic training device as in claim 1, wherein said upright is provided with receptacles, said planar training shape is provided with through holes, and said planar training shape is releasably mounted on said upright by means of at least one elongated member inserted through one of said through holes and one of said receptacles.

8. An athletic training device as in claim 1, wherein said planar training shape is representative of a basketball training shape.

9. An athletic training device as in claim 1, wherein said planar training shape is representative of a football training shape.

10. An athletic training device as in claim 1, wherein said planar training shape is representative of a soccer training shape.

11. An athletic training device as in claim 1, wherein said planar training shape is representative of a baseball training shape.

12. An athletic training device as in claim 1, wherein said planar training shape includes upper leg members and lower leg members articulated at an attachment of the upper leg member to the torso and at an attachment of the lower leg segment to the upper leg member.

13. An athletic training device as in claim 1, wherein said upright is a quick-release telescopic upright comprising a lower hollow cylindrical upright fixed to the base and an upper upright dimensioned for being slidingly displaceable within the fixed upright, wherein said training shape is releasably attached to the upper upright, wherein said upper upright and lower upright are provided with bore holes, and wherein said upper upright is inserted into said lower upright and held in place by means of a retaining pin through a bore hole.

* * * * *